US012359880B2

(12) United States Patent
Xiao et al.

(10) Patent No.: US 12,359,880 B2
(45) Date of Patent: Jul. 15, 2025

(54) HEAT EXCHANGER AND AIR CONDITIONING UNIT HAVING MULTIPLE REFRIGERATION SYSTEMS

(71) Applicant: SANHUA (HANGZHOU) MICRO CHANNEL HEAT EXCHANGER CO., LTD., Zhejiang (CN)

(72) Inventors: Ruixue Xiao, Zhejiang (CN); Jianlong Jiang, Zhejiang (CN)

(73) Assignee: SANHUA (HANGZHOU) MICRO CHANNEL HEAT EXCHANGER CO., LTD., Zhejiang (CN)

( * ) Notice: Subject to any disclaimer, the term of this patent is extended or adjusted under 35 U.S.C. 154(b) by 307 days.

(21) Appl. No.: 18/246,119

(22) PCT Filed: Sep. 23, 2021

(86) PCT No.: PCT/CN2021/119935
§ 371 (c)(1),
(2) Date: Mar. 21, 2023

(87) PCT Pub. No.: WO2022/063182
PCT Pub. Date: Mar. 31, 2022

(65) Prior Publication Data

US 2023/0358486 A1 Nov. 9, 2023

(30) Foreign Application Priority Data

Sep. 23, 2020 (CN) ..... 202011009805.4

(51) Int. Cl.
*F28F 9/02* (2006.01)
*F25B 39/00* (2006.01)
(Continued)

(52) U.S. Cl.
CPC ..... *F28F 9/0204* (2013.01); *F25B 39/00* (2013.01); *F28F 9/0224* (2013.01); *F25B 39/028* (2013.01);
(Continued)

(58) Field of Classification Search
CPC ..... F25B 39/00; F25B 39/028; F25B 39/04; F28F 9/0204; F28F 9/0224; F28F 9/0243;
(Continued)

(56) References Cited

U.S. PATENT DOCUMENTS

2008/0289806 A1 11/2008 Gorbounov et al.
2014/0096944 A1* 4/2014 Seo ..... F28F 9/0273 165/174
2020/0200449 A1* 6/2020 Minami ..... F28F 9/0214

FOREIGN PATENT DOCUMENTS

CN 202993924 U 6/2013
CN 203719250 U 7/2014
CN 205718634 U 11/2016

OTHER PUBLICATIONS

International Search Report dated Jan. 29, 2022 for corresponding International Application No. PCT/ CN2021/119935, filed Sep. 23, 2021.

(Continued)

*Primary Examiner* — Joseph F Trpisovsky
(74) *Attorney, Agent, or Firm* — David D. Brush; Westman, Champlin & Koehler, P.A.

(57) ABSTRACT

A heat exchanger includes a first collecting tube, a second collecting tube, first heat exchange tubes, and second heat exchange tubes. The first heat exchange tubes and the second heat exchange tubes are alternately arranged along the length direction of the first collecting tube. A first assembly separates a first main channel in the first collecting tube into a first flow channel and a second flow channel. The first flow channel includes a first channel, and first lumens.

(Continued)

The first lumens are communicated with first heat exchange tubes. The second flow channel includes a second channel and second lumens. The second lumens are communicated with second heat exchange tubes. The heat exchanger can be applied to an air conditioning unit having multiple refrigeration systems.

20 Claims, 5 Drawing Sheets

(51) Int. Cl.
*F25B 39/02* (2006.01)
*F25B 39/04* (2006.01)

(52) U.S. Cl.
CPC ..... *F25B 39/04* (2013.01); *F28F 2009/0287* (2013.01); *F28F 2009/0297* (2013.01)

(58) Field of Classification Search
CPC ..... F28F 9/0265; F28F 2009/0287; F28F 2009/0297; F28D 1/0408; F28D 1/05375; F28D 2021/0068
See application file for complete search history.

(56) References Cited

OTHER PUBLICATIONS

Written Opinion of the International Searching Authority dated Jan. 29, 2022 for corresponding International Application No. PCT/CN2021/119935, filed Sep. 23, 2021.

* cited by examiner

HEAT EXCHANGER AND AIR CONDITIONING UNIT HAVING MULTIPLE REFRIGERATION SYSTEMS

CROSS-REFERENCE TO RELATED APPLICATION

This application is a national phase entry under 35 USC § 371 of International Application PCT/CN2021/119935, filed Sep. 23, 2021, which claims priority to and benefit of the Chinese Patent Application No. 202011009805.4 filed on Sep. 23, 2020, the entire content of which is incorporated herein by reference.

TECHNICAL FIELD

The present disclosure relates to a field of heat exchange technologies, and more particularly, to a heat exchanger and an air conditioning unit having multiple refrigeration systems including the heat exchanger.

BACKGROUND

An air conditioning having multiple refrigeration systems adopts a plurality of separate refrigerant circuits. In the related art, the plurality of refrigerant circuits may adopt a parallel-flow heat exchanger as a heat exchanger shared by multiple systems, and the parallel-flow heat exchanger in the system share one fan system and one ventilation surface.

During operation under partial load, the refrigerant flows in part of the refrigerant circuit in the air conditioner having multiple refrigeration systems, while no refrigerant flow in the other part of the refrigerant circuit. Therefore, the shared parallel-flow heat exchanger requires different refrigeration circuits, a plurality of flow collecting components, such as headers, for refrigerant distribution. The flow collecting components do not participate in the heat exchange, which reduces utilization rate of the heat exchange area on the ventilation surface and affects the heat exchange performance. Therefore, this effect needs to be improved.

SUMMARY

A heat exchanger according to embodiments of a first aspect of the present disclosure includes a first collecting tube and a second collecting tube, the first collecting tube including a first peripheral wall and a first main channel, and a wall surrounding the first main channel including the first peripheral wall; a plurality of heat exchange tubes spaced apart along a length direction of the first collecting tube, the heat exchange tube being coupled to the first collecting tube, the heat exchange tube being coupled to the second collecting tube, the plurality of heat exchange tubes including a plurality of first heat exchange tubes and a plurality of second heat exchange tubes, the first heat exchange tube and the second heat exchange tube being alternately arranged along the length direction of the first collecting tube, and at least two second heat exchange tubes being arranged adjacent to the first heat exchange tube in the length direction of the first collecting tube; a first assembly located in the first main channel, the first main channel including a first flow channel and a second flow channel, at least part of the first assembly being fixedly coupled to an inner wall surface of the first collecting tube, the first flow channel including a first channel and a plurality of first lumens, the first channel extending in the length direction of the first collecting tube and in communication with the plurality of first lumens, the second flow channel including a second channel and a plurality of second lumens, the second channel extending in the length direction of the first collecting tube and in communication with the plurality of second lumens, the first lumen and the second lumen being alternately arranged along the length direction of the first collecting tube, the first assembly separating the first lumen from the second lumen, the first lumen and the second lumen being not in communication with each other, the first lumen being in communication with the first heat exchange tube, and the second lumen being in communication with the second heat exchange tube; a first inlet-outlet tube in communication with the first channel; and a second inlet-outlet tube in communication with the second channel.

An air conditioning unit having multiple refrigeration systems according to embodiments of a second aspect of the present disclosure includes a plurality of refrigeration systems, at least two refrigeration systems of the plurality of refrigeration systems share at least one heat exchanger, the heat exchanger is an evaporator and/or a condenser of the at least two refrigeration systems, and the heat exchanger is a heat exchanger described in any one of the above embodiments.

DETAILED DESCRIPTION

Figure 1:
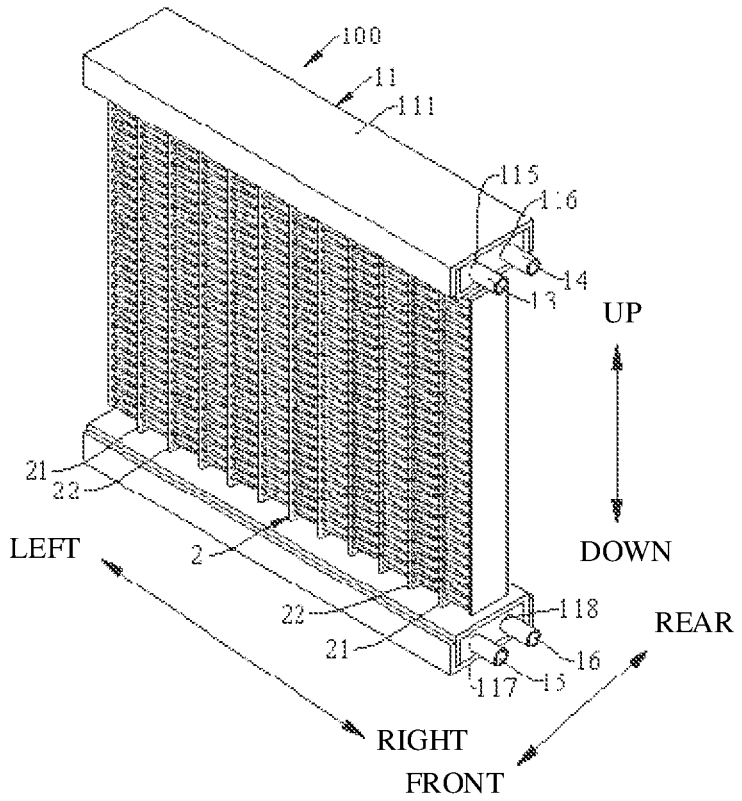
FIG. 1 is a perspective view of a heat exchanger according to an embodiment of the present disclosure.

Embodiments of the present disclosure are described in detail below, and examples of the embodiments are shown in accompanying drawings. The following embodiments described with reference to the accompanying drawings are illustrative and are only intended to explain the present disclosure, rather than limit the present disclosure. In the description of the present disclosure, it shall be understood that terms such as "central," "longitudinal," "transverse," "length," "width," "thickness," "upper," "lower," "front," "rear," "left," "right," "vertical," "horizontal," "top," "bottom," "inner," "outer," "clockwise," "counterclockwise," "axial," "radial" and "circumferential" should be construed to refer to the orientation and position as then described or as shown in the drawings under discussion. These relative terms are only for convenience of description and do not indicate or imply that the device or element referred to must have a particular orientation, or be constructed and operated in a particular orientation. Thus, these terms shall not be construed as limitation on the present disclosure.

As illustrated in FIGS. 1 to 14, a heat exchanger 100 according to embodiments of the present disclosure includes a first collecting tube 11, a second collecting tube 12, a plurality of heat exchange tubes 2, a first assembly 3, a first inlet-outlet tube 13, and a second inlet-outlet tube 14.

Figure 2:
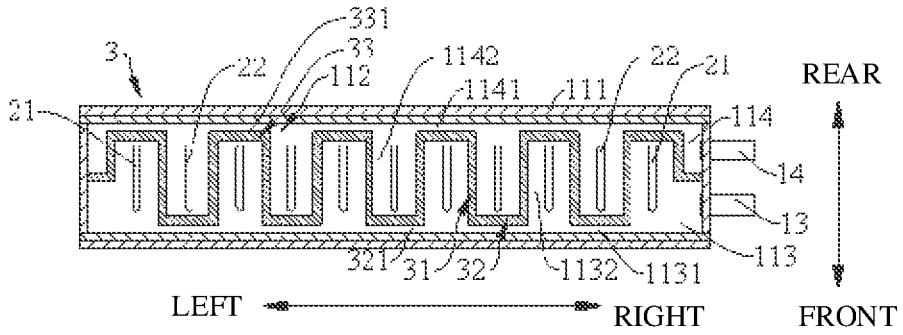
FIG. 2 is a sectional view of an illustrative first assembly of the heat exchanger in FIG. 1.

The first collecting tube 11 includes a first peripheral wall 111 and a first main channel 112 surrounded by the first peripheral wall 111. As illustrated in FIGS. 1 and 2, the first collecting tube 11 and the second collecting tube 12 are arranged in parallel along an up-down direction, and the first collecting tube 11 includes the first peripheral wall 111 and the first main channel 112 surrounded by the first peripheral wall 111.

The plurality of heat exchange tubes 2 are spaced apart in a length direction of the first collecting tube 11 (a left-right direction as illustrated in FIG. 1). The heat exchange tube 2 communicates the first collecting tube 11 with the second collecting tube 12. The plurality of heat exchange tubes 2 include a plurality of first heat exchange tubes 21 and a plurality of second heat exchange tubes 22, the first heat exchange tube 21 and the second heat exchange tube 22 are alternately arranged along the length direction of the first collecting tube 11, and at least two second heat exchange tubes 22 are arranged adjacent to the first heat exchange tube 21 in the length direction of the first collecting tube 11.

As illustrated in FIGS. 1 and 2, the plurality of heat exchange tubes 2 include the plurality of first heat exchange tubes 21 and the plurality of second heat exchange tubes 22. The plurality of first heat exchange tubes 21 and the plurality of second heat exchange tubes 22 are spaced apart and arranged alternately from left to right, and at least two second heat exchange tubes 22 are arranged adjacent to the first heat exchange tube 21 in the left-right direction. Upper ends of the plurality of first heat exchange tubes 21 are in communication with the first collecting tube 11, and lower ends of the plurality of first heat exchange tubes 21 are in communication with the second collecting tube 12. Upper ends of the plurality of second heat exchange tubes 22 are in communication with the first collecting tube 11, and lower ends of the plurality of second heat exchange tubes 22 are in communication with the second collecting tube 12.

The first assembly 3 is located in the first main channel 112, the first main channel 112 includes a first flow channel 113 and a second flow channel 114, and at least part of the first assembly 3 is fixedly coupled to an inner wall surface of the first collecting tube 11.

As illustrated in FIGS. 1 and 2, the first peripheral wall 111 includes a left wall and a right wall. The first assembly 3 is arranged in the first main channel 112. The first assembly 3 includes an upper end surface, a lower end surface, a front side surface and a rear side surface. The upper end surface of the first assembly 3 is coupled to an inner wall surface of the first peripheral wall 111, the lower end surface of the first assembly 3 is coupled to the inner wall surface of the first peripheral wall 111, a left end of the first assembly 3 is coupled to the left wall of the first peripheral wall 111, and a right end of the first assembly 3 is coupled to the right wall of the first peripheral wall 111. A gap is defined between the front side surface of the first assembly 3 and the inner wall surface of the first peripheral wall 111, and a gap is defined between the rear side surface of the first assembly 3 and the inner wall surface of the first peripheral wall 111. Thus, the first assembly 3 is arranged in the first main channel 112 and separates the first main channel 112 into the first flow channel 113 and the second flow channel 114, and the first flow channel 113 and the second flow channel 114 are not in communication with each other. The first flow channel 113 is located between the front side surface of the first assembly 3 and the inner wall surface of the first peripheral wall 111, and the second flow channel 114 is located between the rear side surface of the first assembly 3 and the inner wall surface of the first peripheral wall 111.

The first flow channel 113 includes a first channel 1131 and a plurality of first lumens 1132, and the first channel 1131 extends in the length direction of the first collecting tube 11 and is in communication with the plurality of first lumens 1132. The second flow channel 114 includes a second channel 1141 and a plurality of second lumens 1142, the second channel 1141 extends in the length direction of the first collecting tube 11 and is in communication with the plurality of second lumens 1142.

The first lumen 1132 and the second lumen 1142 are alternately arranged along the length direction of the first collecting tube 11, the first assembly 3 separates the first lumen 1132 from the second lumen 1142, and the first lumen 1132 and the second lumen 1142 are not in communication with each other. The first lumen 1132 is in communication with the first heat exchange tube 21, and the second lumen 1142 is in communication with the second heat exchange tube 22. It can be understood that the alternate arrangement means that the first lumen 1132 and the second lumen 1142 which are provided in a same number are arranged along the length direction of the first collecting tube 11, or the first lumen 1132 and the second lumen 1142 which are provided in different numbers are arranged along the length direction of the first collecting tube 11. The alternate arrangement requires that at least two first lumens are arranged adjacent to the second lumen on two sides of the length direction of the first collecting tube 11, respectively, or at least two second lumens are arranged adjacent to the first lumen on two sides of the length direction of the first collecting tube 11, respectively.

As illustrated in FIGS. 1 and 2, the first assembly 3 extends in the left-right direction in the first main channel 11, and a longitudinal section of the first assembly 3 is approximately in an S-shape which is bent continuously. The first assembly 3 separates the first flow channel 113 into one first channel 1131 and the plurality of first lumens 1132, and the first channel 1131 is in communication with the plurality of first lumens 1132. Similarly, the first assembly 3 separates the second flow channel 114 into one second channel 1141 and the plurality of second lumens 1142, and the second channel 1141 is in communication with the plurality of second lumens 1142. The first lumen 1132 and the second lumen 1142 are alternately arranged in the left-right direction, and the first lumen 1132 and the second lumen 1142 are not in communication with each other. The first lumen 1132 is in communication with the first heat exchange tube 21, the number of the first lumens 1132 is the same as the number of the first heat exchange tubes 21, and the plurality of first lumens 1132 are in one-to-one correspondence with the plurality of first heat exchange tubes 21. The second lumen 1142 is in communication with the second heat exchange tube 22, the number of the second lumens 1142 is the same as the number of the second heat exchange tubes 22, and the plurality of second lumens 1142 are in one-to-one correspondence with the plurality of second heat exchange tubes 22.

The first inlet-outlet tube 13 is in communication with the first channel 1131, and the second inlet-outlet tube 14 is in communication with the second channel 1141. As illustrated in FIGS. 1 and 2, the right wall of the first peripheral wall 111 includes a first coupling port 115 and a second coupling port 116 spaced apart from each other in a front-rear direction, and each of the first coupling port 115 and the second coupling port 116 penetrates through the right wall of the first peripheral wall 111 in the left-right direction. The right end of the first assembly 3 is located between the first coupling port 115 and the second coupling port 116 to separate the first coupling port 115 from the second coupling port 116. The first inlet-outlet tube 13 passes through the first coupling port 115 and is in communication with the first channel 1131. The second inlet-outlet tube 14 passes through the second coupling port 116 and is in communication with the second channel 1141.

In the heat exchanger according to embodiments of the present disclosure, the first collecting tube and the second collecting tube are arranged, the plurality of first heat exchange tubes and the plurality of second heat exchange tubes are arranged between the first collecting tube and the second collecting tube, and the plurality of first heat exchange tubes and the plurality of second heat exchange tubes are alternately arranged along the length direction of the first collecting tube. The first assembly is arranged in the first collecting tube to allow the first main channel in the first collecting tube to include the first flow channel and the second flow channel. The first flow channel includes the first channel and the plurality of first lumens, and the plurality of first lumens are coupled to the plurality of first heat exchange tubes, respectively. The second flow channel includes the second channel and the plurality of second lumens, and the plurality of second lumens are coupled to the plurality of second heat exchange tubes, respectively. Therefore, when the heat exchanger is applied in an air conditioning unit having multiple refrigeration systems, a refrigerant may only circulate in the first flow channel and the first heat exchange tube, or the refrigerant may only circulate in the second flow channel and the second heat exchange tube, or the refrigerant may not only circulate in the first flow channel and the first heat exchange tube, but also circulate in the second flow channel and the second heat exchange tube. In the heat exchanger, multiple systems can share the first collecting tube, thus improving the utilization rate of the heat exchange area, and simultaneously reducing temperature difference at joints of heat exchange tubes in different systems with the first collecting tube and the second collecting tube under a partial load, such that thermal stress concentration of the system is reduced, which is conducive to improving the service life of the heat exchanger.

Figure 3:
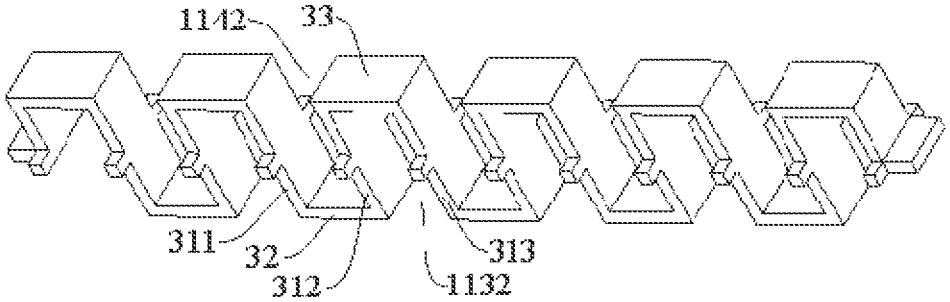
FIG. 3 is a perspective view of the first assembly in FIG. 2.

In some embodiments, as illustrated in FIGS. 1 to 4, a peripheral profile of a cross section of the heat exchange tube 2 is generally flat. The first assembly 3 includes a plurality of body members 31, and the plurality of body members 31 are spaced apart along the length direction of the first collecting tube 11. The body member 31 has a first end (a front end of the body member 31 as illustrated in FIG. 2) and a second end (a rear end of the body member 31 as illustrated in FIG. 2) in a width direction of the first heat exchange tube 21 (the front-rear direction as illustrated in FIG. 1), and the body member 31 has a third end (a lower end of the body member 31 as illustrated in FIG. 3) and a fourth end (an upper end of the body member 31 as illustrated in FIG. 3) in a length direction of the first heat exchange tube 21 (the up-down direction as illustrated in FIG. 1).

The third end of the body member 31 and the fourth end of the body member 31 abut with the inner wall surface of the first collecting tube 11. A minimum distance between the first end of the body member 31 and the second end of the body member 31 is greater than a width of the first heat exchange tube 21, and the minimum distance between the first end of the body member 31 and the second end of the body member 31 is greater than a width of the second heat exchange tube 22.

The first assembly 3 further includes a first coupling member 32, and the first coupling member 32 extends in the length direction of the first collecting tube 11. One end of the first coupling member 32 (a left end of the first coupling member 32 as illustrated in FIG. 2) in the length direction of the first collecting tube 11 is coupled to the first end of one body member 31, and the other end of the first coupling member 32 (a right end of the first coupling member 32 as illustrated in FIG. 2) in the length direction of the first collecting tube 11 is coupled to the first end of another body member 31. A first gap 321 is defined between the first coupling member 32 and the inner wall surface of the first collecting tube 11, the first channel 1131 includes the first gap 321, and the first channel 1131 communicates the plurality of first lumens 1132 with each other through a plurality of first gaps 321.

As illustrated in FIGS. 1 to 3, the peripheral profile of the cross section of the heat exchange tube 2 is generally flat. The heat exchange tube 2 has a length extending in the up-down direction, a width extending in the front-rear direction, and a thickness extending in the left-right direction. The heat exchange tube 2 is a so-called flat tube in the related art.

The first assembly 3 includes a plurality of body members 31 and a plurality of first coupling members 32.

The plurality of body members 31 extend in the front-rear direction and are arranged along the left-right direction, and adjacent body members 31 are spaced apart from each other. The lower end of the body member 31 is coupled to a bottom wall of the first peripheral wall 111, and the upper end of the body member 31 is coupled to a top of the first peripheral wall 111.

A minimum distance from the front end of the body member 31 to the rear end of the body member 31 is a length of the body member 31. The length of the body member 31 is greater than the width of the first heat exchange tube 21 and the width of the second heat exchange tube 22.

The first coupling member 32 extends in the left-right direction. The left end of the first coupling member 32 is coupled to the front end of one body member 31, and the right end of the first coupling member 32 is coupled to the front end of another body member 31. The first gap 321 is defined between a front side surface of the first coupling member 32 and a front wall of the first peripheral wall 111, and the first channel 1131 includes the first gap 321.

Figure 4:
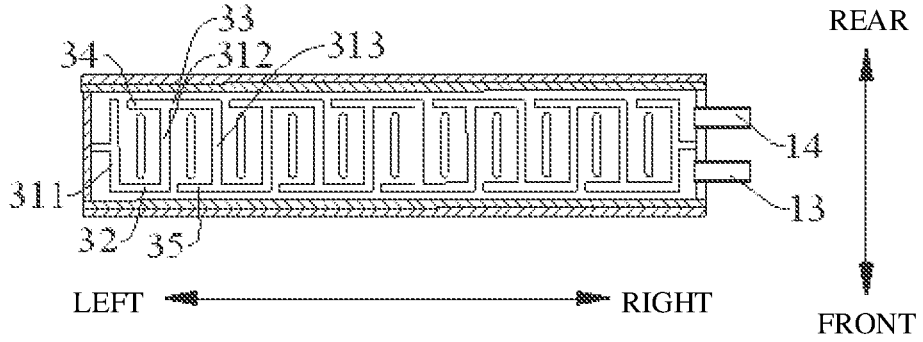
FIG. 4 is a sectional view of another illustrative first assembly of the heat exchanger in FIG. 1.

In some embodiments, as illustrated in FIGS. 2 to 4, the first assembly 3 further includes a second coupling member 33, and the second coupling member 33 extends in the length direction of the first collecting tube 11. One end of the second coupling member 33 (a left end of the second coupling member 33 as illustrated in FIG. 2) in the length direction of the first collecting tube 11 is coupled to the second end of one body member 31, and the other end of the second coupling member 33 (a right end of the second coupling member 33 as illustrated in FIG. 2) in the length direction of the first collecting tube 11 is coupled to the second end of another body member 31. A second gap 331 is defined between the second coupling member 33 and the inner wall surface of the first collecting tube 11, and the second channel 1141 includes the second gap 331.

As illustrated in FIG. 2, the second coupling member 33 extends in the left-right direction. The left end of the second coupling member 33 is coupled to the rear end of one body member 31, and the right end of the second coupling member 33 is coupled to the rear end of another body member 31. The second gap 331 is defined between a rear side surface of the second coupling member 33 and a rear wall of the first peripheral wall 111, and the second channel 1141 includes the second gap 331.

In some embodiments, three adjacent body members 31 of the plurality of body members 31 in the length direction of the first collecting tube 11 are defined as a first body member 311, a second body member 312 and a third body member 313. The first body member 311 and the second body member 312 are adjacent in the length direction of the first collecting tube 11, the second body member 312 and the third body member 313 are adjacent in the length direction of the first collecting tube 11, and a direction from the first body member 311 to the second body member 312 are the same as a direction from the second body member 312 to the third body member 313.

As illustrated in FIG. 3, three adjacent body members 31 of the plurality of body members 31 in the left-right direction are defined as the first body member 311, the second body member 312 and the third body member 313. Preferably, the first body member 311, the second body member 312 and the third body member 313 are arranged in parallel along the left-right direction.

A plurality of first coupling members 32 are provided and arranged along the length direction of the first collecting tube 11. One end of the first coupling member 32 (the left end of the first coupling member 32 as illustrated in FIG. 3) in the length direction of the first collecting tube 11 is coupled to a first end of the first body member 311, and the other end of the first coupling member 32 (the right end of the first coupling member 32 as illustrated in FIG. 3) is coupled to a first end of the second body member 312. A gap is defined between a second end of the first body member 311 and a second end of the second body member 312.

As illustrated in FIG. 3, the plurality of first coupling members 32 are spaced apart along the left-right direction. The left end of the first coupling member 32 is coupled to a front end of the first body member 311, the right end of the first coupling member 32 is coupled to a front end of the second body member 312, and the gap is defined between a rear end of the first body member 311 and a rear end of the second body member 312.

A plurality of second coupling members 33 are provided and arranged along the length direction of the first collecting tube 11. One end of the second coupling member 33 (the left end of the second coupling member 33 as illustrated in FIG. 3) in the length direction of the first collecting tube 11 is coupled to the second end of the second body member 312, and the other end of the second coupling member 33 (the right end of the second coupling member 33 as illustrated in FIG. 3) in the length direction of the first collecting tube 11 is coupled to a second end of the third body member 313. A gap is defined between the first end of the second body member 312 and a first end of the third body member 313.

As illustrated in FIG. 3, the plurality of second coupling members 33 are spaced apart along the left-right direction. The left end of the second coupling member 33 is coupled to the rear end of the second body member 312, the right end of the second coupling member 33 is coupled to a rear end of the third body member 313, and the gap is defined between the front end of the second body member 312 and a front end of the third body member 313.

In some embodiments, a peripheral wall surrounding the first lumen 1132 includes the second body member 312, the third body member 313, the second coupling member 33 coupling the second end of the second body member 312 and the second end of the third body member 313, and the inner wall of the first collecting tube 11. The first lumen 1132 is in communication with the first channel 1131. A peripheral wall surrounding the second lumen 1142 includes the first body member 311, the second body member 312, the first coupling member 32 coupling the first end of the first body member 311 and the first end of the second body member 312, and the inner wall of the first collecting tube 11. The second lumen 1142 is in communication with the second channel 1141.

As illustrated in FIGS. 2 and 3, a channel surrounding by the front wall of the first peripheral wall 111, one second body member 312, one third body member 313, and the second coupling member 33 coupling the one second body member 312 and the one third body member 313 is the first lumen 1132, and the first lumen 1132 is in communication with the first channel 1131. A channel surrounding by the rear wall of the first peripheral wall 111, one first body member 311, one second body member 312 and the first coupling member 32 coupling the one first body member 311 and the one second body member 312 is the second lumen 1142, and the second lumen 1142 is in communication with the second channel 1141. In some embodiments, the first lumen 1132 and the second lumen 1142 are alternately arranged along the length direction of the first collecting tube 11. The first heat exchange tube 21 and the second heat exchange tube 22 are coupled to the first lumen 1132 and the second lumen 1142, respectively. Therefore, under the partial load, the heat exchanger can make full use of the heat exchange tube 2 in which the refrigerant does not circulate and fins for heat exchange, which is conducive to improving the heat exchange performance. Moreover, the temperature difference at joints of the first heat exchange tube 21 and the second heat exchange tube 22 with the first collecting tube 11 is reduced, thus reducing stress concentration.

In some embodiments, as illustrated in FIG. 4, the first assembly 3 further includes a third coupling member 34, and the third coupling member 34 extends in the length direction of the first collecting tube 11. A gap is defined between one end of the third coupling member 34 (the left end of the third coupling member 34 as illustrated in FIG. 4) in the length direction of the first collecting tube 11 and the second end of the first body member 311. The other end of the third coupling member 34 (the right end of the third coupling member 34 as illustrated in FIG. 4) in the length direction of the first collecting tube 11 is coupled to the second end of the second body member 312. The peripheral wall surrounding the second lumen 1142 includes the first body member 311, the second body member 312, the first coupling member 32 coupling the first end of the first body member 311 and the first end of the second body member 312, the third coupling member 34 and the inner wall of the first collecting tube 11. The second lumen 1142 is in communication with the second channel 1141.

As illustrated in FIG. 4, the third coupling member 34 extends in the left-right direction, the right end of the third coupling member 34 is coupled to the rear end of the second body member 312, the left end of the third coupling member 34 extends towards the rear end of the first body member 312, and the gap is defined between the left end of the third coupling member 34 and the rear end of the first body member 312. The channel surrounded by the first body member 311, the second body member 312, the first coupling member 32 coupling the front end of the first body member 311 and the front end of the second body member 312, the third coupling member 34 and the rear wall of the first collecting tube 11 is the second lumen 1142, and the second lumen 1142 is in communication with the second channel 1141.

The first assembly 3 further includes a fourth coupling member 35, and the fourth coupling member 35 extends in the length direction of the first collecting tube 11. A gap is defined between one end of the fourth coupling member 35 (a left end of the fourth coupling member 35 as illustrated in FIG. 4) in the length direction of the first collecting tube 11 and the first end of the second body member 312. The other end of the fourth coupling member 35 (a right end of the fourth coupling member 35 as illustrated in FIG. 4) in the length direction of the first collecting tube 11 is coupled to the first end of the third body member 313. A peripheral wall surrounding the first lumen 1132 includes the second body member 312, the third body member 313, the second coupling member 33 coupling the second end of the second body member 312 and the second end of the third body member 313, the fourth coupling member 35 and the inner wall of the first collecting tube 11. The first lumen 1132 is in communication with the first channel 1131.

As illustrated in FIG. 4, the fourth coupling member 35 extends in the left-right direction, the right end of the fourth coupling member 35 is coupled to the front end of the third body member 313, the left end of the fourth coupling member 35 extends towards the front end of the second body member 312, and the gap is defined between the left end of the fourth coupling member 35 and the front end of the second body member 312. A channel surrounded by the second body member 312, the third body member 313, the second coupling member 33 coupling the rear end of the second body member 312 and the rear end of the third body member 313, the fourth coupling member 35 and the front wall of the first collecting tube 11 is the first lumen 1132, and the first lumen 1132 is in communication with the first channel 1131.

In some embodiments, a size of the first coupling member 32 in the length direction of the first collecting tube 11 is greater than or equal to a size of the second coupling member 33 in the length direction of the first collecting tube 11. In some embodiments, a plurality of first coupling members 32 arranged along the length direction of the first collecting tube 11 may have a same size or different sizes in the length direction of the first collecting tube 11. Therefore, the number of the first heat exchange tubes 21 in communication with the first lumen 1132 and the number of the second heat exchange tubes 22 in communication with the second lumen 1142 may be the same or different. In other embodiments, in the length direction of the first collecting tube 11, different first lumens 1132 are coupled to different numbers of the first heat exchange tubes 21. In this design, the first heat exchange tube 21 and the second heat exchange tube 22 which have different heat exchange capacities may be provided, to realize the differentiated partial load design. For example, the cooling capacity of the circuit using the first heat exchange tube 21 is greater than the cooling capacity of the circuit using the second heat exchange tube 22. Therefore, the overall efficiency of the heat exchanger can be improved.

As illustrated in FIGS. 2 to 4, each of the first coupling member 32 and the second coupling member 33 extends in the left-right direction, and a length of the first coupling member 32 in the left-right direction is greater than or equal to a length of the second coupling member 33 in the left-right direction. In some embodiments, the plurality of body members 31 are arranged at a same interval along the left-right direction, such that the length of the first coupling member 32 is the same as the length of the second coupling member 33, i.e., the first coupling member 32 and the second coupling member 33 are processed from a same part, thus reducing the design cost and production cost of the heat exchanger 100 in embodiments of the present disclosure. Moreover, since the first assembly 3 is located in the first collecting tube 11 and coupled to the first collecting tube 11, the strength and pressure resistance of the first collecting tube 11 can be improved.

Figure 5:
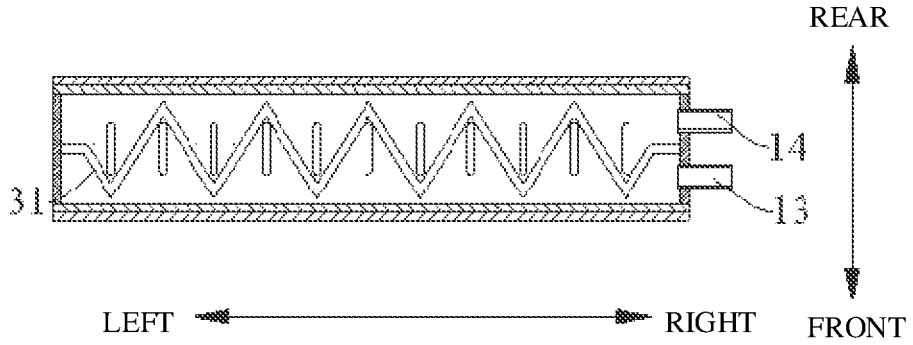
FIG. 5 is a sectional view of still another illustrative first assembly of the heat exchanger in FIG. 1.

In some embodiments, as illustrated in FIGS. 1 and 5, the peripheral profile of the cross section of the heat exchange tube 2 is generally flat. The first assembly 3 includes the plurality of body members 31, and the plurality of body members 31 are spaced apart along the length direction of the first collecting tube 11. The body member 31 has the first end and the second end in the width direction of the first heat exchange tube 21. Two body members 31 of the plurality of body members 31 are adjacent to each other in the length direction of the first collecting tube 11, the first ends of the two body members 31 are coupled to each other, and the second ends of the two body members 31 are spaced apart. The gap is defined between a coupling portion of the first ends of the two body members 31 and the inner wall surface of the first collecting tube 11. The body member 31 has the third end and the fourth end in the length direction of the first heat exchange tube 21, and the third ends and the fourth ends of part of the body members 31 abut with the inner wall surface of the first collecting tube 11.

As illustrated in FIG. 5, the plurality of body members 31 are spaced apart along the left-right direction, and the body member 31 has the front end and the rear end. The front ends of two body members 31 of the plurality of body members 31 are coupled to each other, the rear end of one body member 31 of the two body members 31 is inclined to the left, and the rear end of the other body member 31 of the two body members 31 is inclined to the right. The two body members 31 are approximately in a V-shape after coupling. The gap is defined between the coupling portion of the front ends of the two body members 31 and the front wall of the first peripheral wall 111.

The body member 31 further has the upper end and the lower end. The upper end of the body member 31 is coupled to the top wall of the first peripheral wall 111, and the lower end of the body member 31 is coupled to the bottom wall of the first peripheral wall 111.

In some embodiments, two body members 31 of the plurality of body members 31 are adjacent to each other in the length direction of the first collecting tube 11, the second ends of the two body members 31 are coupled to each other, the first ends of the two body members 31 are spaced apart, and the gap is defined between the coupling portion of the second ends of the two body members 31 and the inner wall surface of the first collecting tube 11. In the length direction of the first collecting tube 11, the coupling portion of the first ends of two adjacent body members 31 and the coupling portion of the second ends of two adjacent body members 31 are alternately arranged.

As illustrated in FIG. 5, the plurality of body members 31 are spaced apart along the left-right direction, and the body member 31 has the front end and the rear end. The rear ends of two body members 31 of the plurality of body members 31 are coupled to each other, the front end of one body member 31 of the two body members 31 is inclined to the left, and the front end of the other body member 31 of the two body members 31 is inclined to the right. The two body members 31 are approximately in a V-shape after coupling. The gap is defined between the coupling portion of the rear ends of the two body members 31 and the rear wall of the first peripheral wall 111. In the left-right direction, the coupling portion of the front ends of two adjacent body members 31 and the coupling portion of the rear ends of two adjacent body members 31 are alternately arranged.

Figure 6:
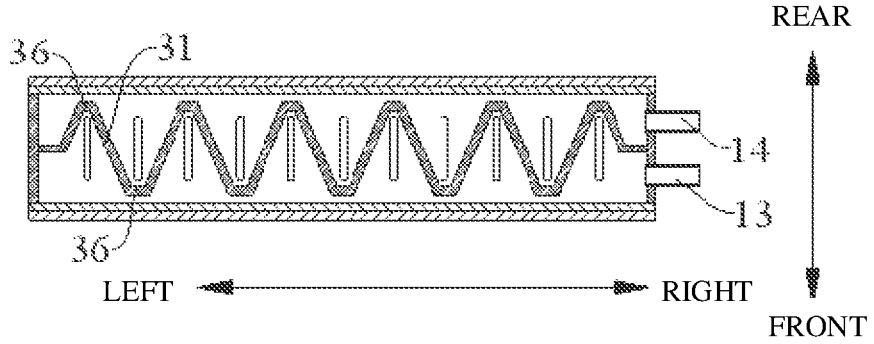
FIG. 6 is a sectional view of yet another illustrative first assembly of the heat exchanger in FIG. 1.

As illustrated in FIG. 6, in other optional embodiments, the first assembly 3 further includes a plurality of coupling portions 36, and the plurality of coupling portions 36 are spaced apart along the left-right direction. Part of the plurality of coupling portions 36 couple the front ends of two adjacent body members 31, thus making the coupling between the front ends of the two adjacent body members 31 more stable, and increasing the distance between the body member 31 and the front end of the second heat exchange tube 22, which is conducive to the circulation of refrigerant. Another part of the plurality of coupling portions 36 couple the rear ends of two adjacent body members 31, which makes the coupling between the rear ends of the two adjacent body members 31 more stable, and increasing the distance between the body member 31 and the rear end of the first heat exchange tube 21, which is conducive to the circulation of refrigerant.

Figure 7:
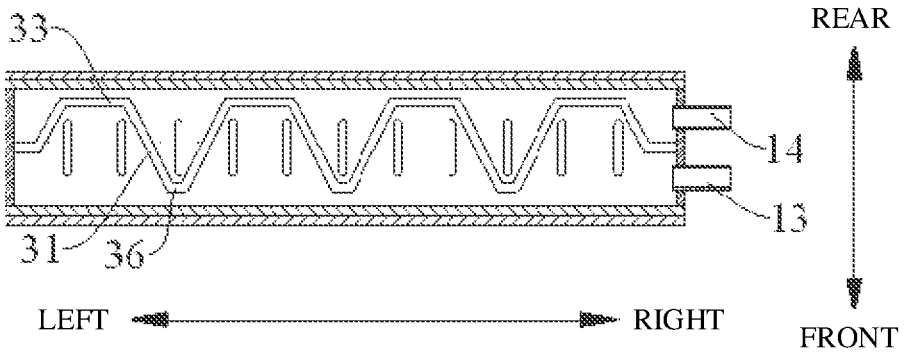
FIG. 7 is a sectional view of yet another illustrative first assembly of the heat exchanger in FIG. 1.
Figure 8:
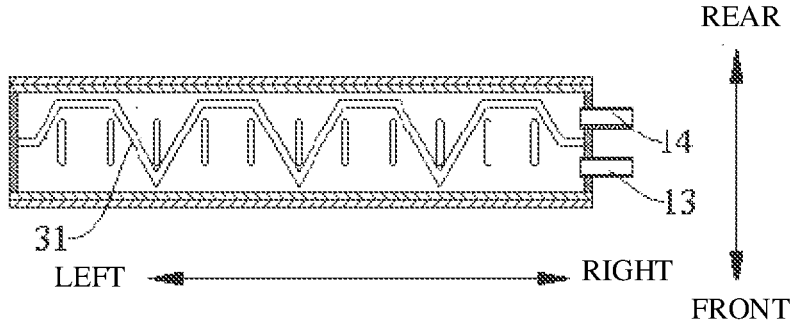
FIG. 8 is a sectional view of yet another illustrative first assembly of the heat exchanger in FIG. 1.

As illustrated in FIGS. 7 and 8, in other optional embodiments, the first lumen 1132 is coupled to two or more first heat exchange tubes 21, i.e., a size of one first lumen 1132 in the length direction of the first collecting tube 11 is larger than a size of one second lumen 1142 in the length direction of the first collecting tube 11. Therefore, the first heat exchange tube 21 and the second heat exchange tube 22 of the heat exchanger 100 may be provided in different numbers which are proportional to each other, thus realizing the differential matching of the partial load in the heat exchanger 100, such that more refrigerant circulates in the first flow channel 113, and the heat exchange efficiency of the first flow channel 113 and the first heat exchange tube 21 is improved.

Figure 9:
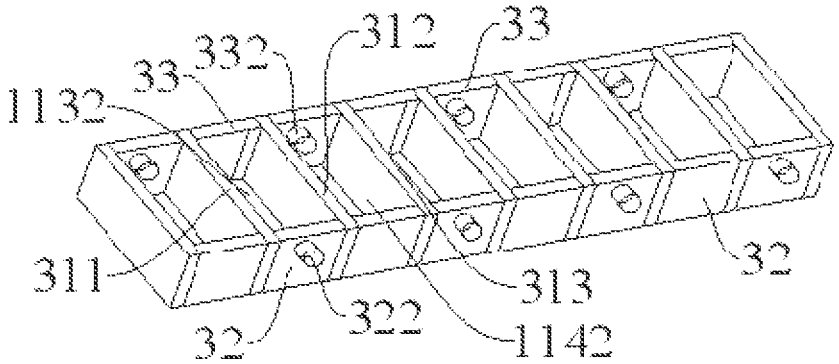
FIG. 9 is a perspective view of yet another illustrative first assembly of the heat exchanger in FIG. 1.

In some embodiments, as illustrated in FIG. 9, three adjacent body members 31 of the plurality of body members 31 in the length direction of the first collecting tube 11 are defined as the first body member 311, the second body member 312 and the third body member 313. The first body member 311 and the second body member 312 are adjacent in the length direction of the first collecting tube 11, the second body member 312 and the third body member 313 are adjacent in the length direction of the first collecting tube 11, and the direction from the first body member 311 to the second body member 312 are the same as the direction from the second body member 312 to the third body member 313.

A plurality of first coupling members 32 are provided. One end of one first coupling member 32 (the left end of the first coupling member 32 as illustrated in FIG. 9) in the length direction of the first collecting tube 11 is coupled to the first end of the first body member 311, and the other end of the one first coupling member 32 (the right end of the first coupling member 32 as illustrated in FIG. 9) in the length direction of the first collecting tube 11 is coupled to the first end of the second body member 312. A plurality of the second coupling members 33 are provided. One end of one second coupling member 33 (the left end of the second coupling member 33 as illustrated in FIG. 9) in the length direction of the first collecting tube 11 is coupled to the second end of the first body member 311, and the other end of the second coupling member 33 (the right end of the second coupling member 33 as illustrated in FIG. 9) in the length direction of the first collecting tube 11 is coupled to the second end of the second body member 312. The first coupling member 32 includes a first through hole 322. The peripheral wall surrounding the first lumen 1132 includes one first coupling member 32, one second coupling member 33, the first body member 311 and the second body member 312. The first through hole 322 penetrates through the first coupling member 32 in the width direction of the first heat exchange tube 21 and communicates the first lumen 1132 with the first channel 1131.

As illustrated in FIG. 9, the plurality of body members 31 are spaced apart along the left-right direction, and three adjacent body members 31 are defined as the first body member 311, the second body member 312, and the third body member 313, respectively. The first coupling member 32 extends in the left-right direction, the left end of the first coupling member 32 is coupled to the front end of the first body member 311, and the right end of the first coupling member 32 is coupled to the front end of the second body member 312. The first coupling member 32 includes the first through hole 322, and the first through hole 322 penetrates through the first coupling member 32 along the front-rear direction and communicates the first lumen 1132 with the first channel 1131. The second coupling member 33 extends in the left-right direction, the left end of the second coupling member 33 is coupled to the rear end of the first body member 311, and the right end of the second coupling member 33 is coupled to the rear end of the second body member 312. The peripheral wall surrounding the first lumen 1132 includes one first coupling member 32, one second coupling member 33, one first body member 311 and one second body member 312.

In some embodiments, one end of one first coupling member 32 (the left end of the first coupling member 32 as illustrated in FIG. 9) in the length direction of the first collecting tube 11 is coupled to the first end of the second body member 312, and the other end of the one first coupling member 32 (the right end of the first coupling member 32 as illustrated in FIG. 9) in the length direction of the first collecting tube 11 is coupled to the first end of the third body member 313. A plurality of second coupling members 33 are provided. One end of one second coupling member 33 (the left end of the second coupling member 33 as illustrated in FIG. 9) in the length direction of the first collecting tube 11 is coupled to the second end of the second body member 312, and the other end of the one second coupling member 33 (the right end of the second coupling member 33 as illustrated in FIG. 9) in the length direction of the first collecting tube 11 is coupled to the second end of the third body member 313. The second coupling member 33 includes a second through hole 332. The peripheral wall surrounding the second lumen 1142 includes one first coupling member 32, one second coupling member 33, the second body member 312 and the third body member 313. The second through hole 332 penetrates through the second coupling member 33 in the width direction of the first heat exchange tube 21 and communicates the second lumen 1142 with the second channel 1141.

As illustrated in FIG. 9, a plurality of first coupling members 32 are provided. Part of the plurality of first coupling members 32 include the first through hole 322, while another part of the plurality of first coupling members 32 do not include the first through hole 322. The left end of one first coupling member 32 is coupled to the front end of the second body member 312, the right end of the one first coupling member 32 is coupled to the front end of the third body member 313, and the one first coupling member 32 does not include the first through hole 322.

The left end of the second coupling member 33 is coupled to the rear end of the second body member 312, and the right end of the second coupling member 33 is coupled to the rear end of the third body member 313. The second coupling member 33 includes the second through hole 332, and the second through hole 332 penetrates through the second coupling member 33 along the front-rear direction and communicates the second lumen 1142 and the second channel 1141. The peripheral wall surrounding the second lumen 1142 includes one first coupling member 32, one second coupling member 33, one second body member 312 and one third body member 313. The first channel 1131 is in communication with the first lumen 1132 via the through hole in the first coupling member 32, and the second channel 1141 is in communication with the second lumen 1142 via the through hole in the second coupling member 33. The number of the first lumen 1132 and the number the second lumen 1142 may be designed and adjusted according to the application situation, thus improving the heat exchange efficiency of the heat exchanger. In some embodiments, one or a plurality of first through holes 321 may be provided in one first coupling member 32. The heat exchanger is used as a common evaporator in a circuit having a plurality of system. The refrigerant under condition of two phase flow enters the first collecting tube 11. By designing the size and quantity of the through holes in the first coupling member 32 and the second coupling member 33, the pressure and rate of flow of the passing refrigerant are adjusted to achieve the uniform distribution of the refrigerant and to reduce the gas-liquid separation. In other embodiments, in the length direction of the first collecting tube 11, the through holes in the first coupling member 32 far from the refrigerant inlet of the first channel 1131 may have a larger flow sectional area or be provided in a larger number, and the through holes in the first coupling member 32 close to the refrigerant inlet of the first channel 1131 may have a smaller flow area or be provided in a smaller number, such that the refrigerant distribution in the length direction of the first collecting tube 11 can be adjusted.

Figure 10:
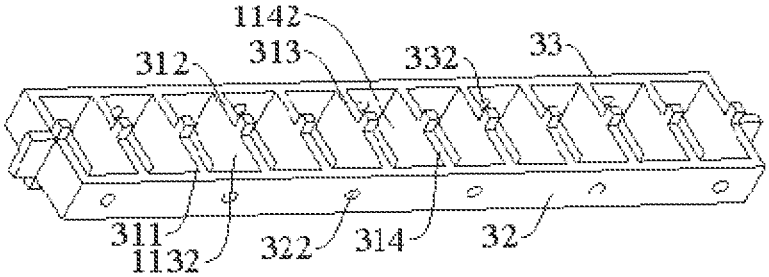
FIG. 10 is a perspective view of yet another illustrative first assembly of the heat exchanger in FIG. 1.
Figure 11:
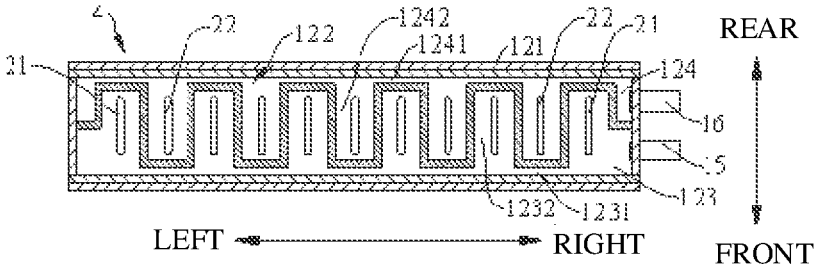
FIG. 11 is a sectional view of an illustrative second assembly of the heat exchanger in FIG. 1.
Figure 13:
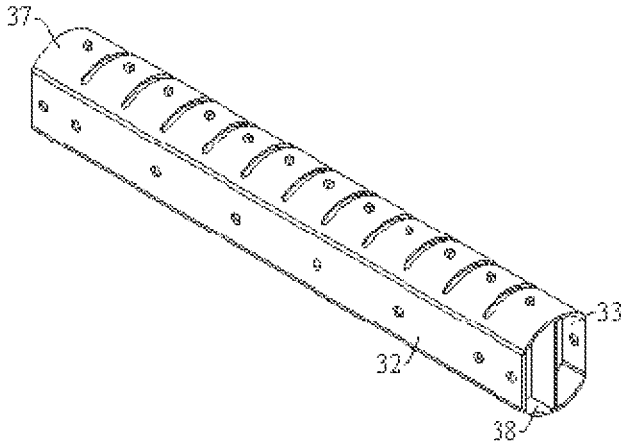
FIG. 13 is a perspective view of an illustrative first assembly of the heat exchanger in FIG. 12.
Figure 14:
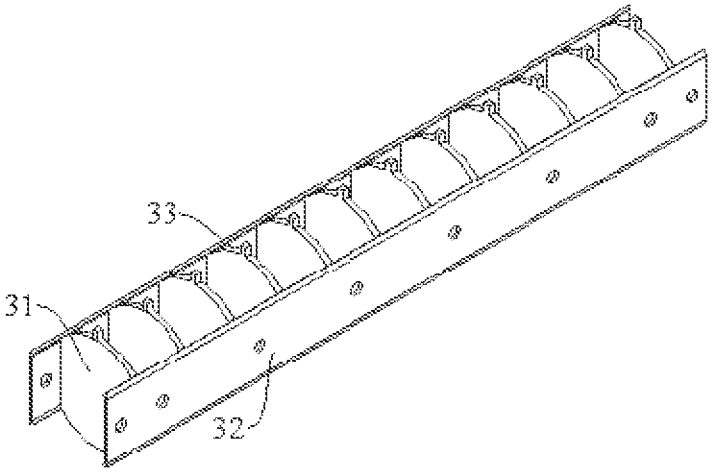
FIG. 14 is a perspective view of another illustrative first assembly of the heat exchanger in FIG. 12.

In some embodiments, as illustrated in FIGS. 10, 13 and 14, the first coupling member 32 and the second coupling member 33 are spaced apart in the width direction of the first heat exchange tube 21, the first ends of the plurality of body members 31 are coupled to the first coupling member 32, and the second ends of the plurality of body members 31 are coupled to the second coupling member 33. Two body members 31 of the plurality of body members 31 adjacent to each other in the length direction of the first collecting tube 11 are defined as the first body member 311 and the second body member 312, and another two body members 31 adjacent to each other in the length direction of the first collecting tube 11 are defined as the third body member 313 and a fourth body member 314.

The first coupling member 32 includes the plurality of first through holes 322, the first through hole 322 penetrates through the first coupling member 32 in the width direction of the first heat exchange tube 21, the second coupling member 33 includes the plurality of second through holes 332, and the second through hole 332 penetrates through the second coupling member 33 in the width direction of the first heat exchange tube 21. The peripheral wall forming the first lumen 1132 includes part of the first coupling member 32, part of the second coupling member 33, the first body member 311, the second body member 312 and part of the first peripheral wall 111, and the first through hole 322 communicates the first lumen 1132 with the first channel 1131. The peripheral wall forming the second lumen 1142 includes part of the first coupling member 32, part of the second coupling member 33, the third body member 313, the fourth body member 314 and part of the first peripheral wall 111, and the second through hole 332 communicates the second lumen 1142 with the second channel 1141. The first lumen 1132 is not in communication with the second channel 1141, and the second lumen 1142 is not in communication with the first channel 1131.

As illustrated in FIG. 10, the first coupling member 32 and the second coupling member 33 are arranged in parallel in the front-rear direction, and the plurality of body members 31 are arranged in parallel in the left-right direction. The front ends of the plurality of body members 31 are coupled to the first coupling member 32, respectively, and the rear ends of the plurality of body members 31 are coupled to the second coupling member 33, respectively.

Two body members 31 of the plurality of body members 31 adjacent to each other in the left-right direction are defined as the first body member 311 and the second body member 312, and another two body members 31 adjacent to each other in the left-right direction are defined as the third body member 313 and the fourth body member 314.

The first coupling member 32 includes the plurality of first through holes 322, and the first through hole 322 penetrates through the first coupling member 32 in the front-rear direction and communicates the first lumen 1132 with the first channel 1131. The second coupling member 33 includes the plurality of second through holes 332, the second through hole 332 penetrates through the second coupling member 33 in the front-rear direction and communicates the second lumen 1142 with the second channel 1141. The first lumen 1132 is not in communication with the second channel 1141, and the second lumen 1142 is not in communication with the first channel 1131.

The peripheral wall forming the first lumen 1132 includes part of the first coupling member 32, part of the second coupling member 33, the first body member 311, the second body member 312 and part of the first peripheral wall 111. The peripheral wall forming the second lumen 1142 includes part of the first coupling member 32, part of the second coupling member 33, the third body member 313, the fourth body member 314 and part of the first peripheral wall 111. The first coupling member 32 and the second coupling member 33 are arranged along the length direction of the first collecting tube 11, which is conducive to improving the strength of the first collecting tube 11. Moreover, as a part of a wall surface forming the first channel 1131, the surface on a side of the first coupling member 32 may be designed. For example, the surface of the first coupling member 32 has a protrusion to adjust the pressure and rate of flow of refrigerant in the first channel 1131 and to improve the distribution efficiency of the refrigerant.

In some embodiments, the first collecting tube 11 is a circular tube, each of an end surface of the third end and an end surface of the fourth end of the body member 31 is an arc-shaped surface projecting towards the inner wall surface of the first collecting tube 11, and each of the end surface of the third end and the end surface of the fourth end of the body member 31 is coupled to the inner wall surface of the first collecting tube 11.

Figure 12:
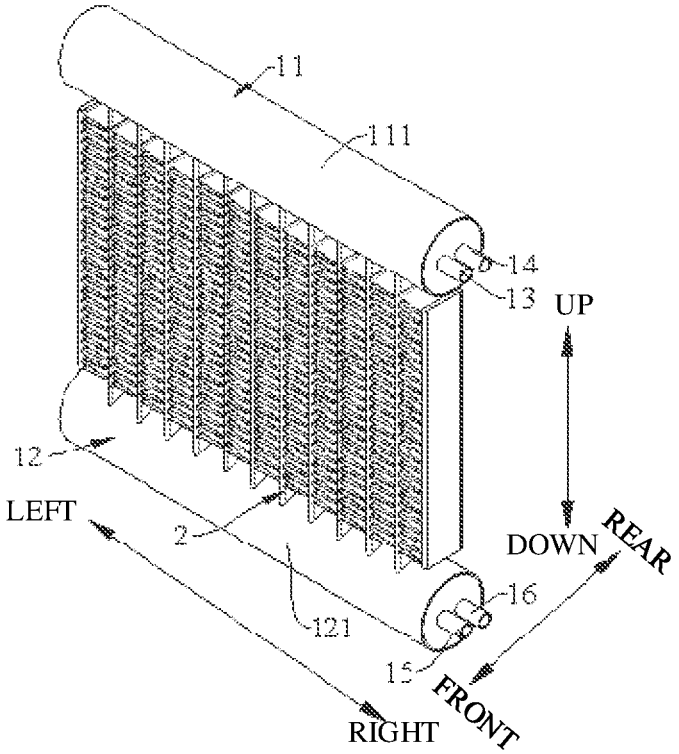
FIG. 12 is a perspective view of a heat exchanger according to another embodiment of the present disclosure.

As illustrated in FIGS. 12 to 14, the first collecting tube 11 is a circular tube, each of an upper end surface and a lower end surface of the body member 31 is an arc-shaped surface, and each of the upper end surface and the lower end surface of the body member 31 is coupled to the inner wall surface of the first peripheral wall 111.

In some embodiments, the first collecting tube 11 is a circular tube, a rectangular tube or a square tube. The first assembly 31 further includes a first plate 37, and the first plate 37 has a first side surface (a front side surface of the first plate 37 as illustrated in FIG. 13) and a second side surface (a rear side surface of the first plate 37 as illustrated in FIG. 13) in the width direction of the first heat exchange tube 21. The first coupling member 32 has a first side surface (an upper side surface of the first coupling member 32 as illustrated in FIG. 13) and a second side surface (a lower side surface of the first coupling member 32 as illustrated in FIG. 13) in the length direction of the first heat exchange tube 21, and the second coupling member 33 has a first side surface (an upper side surface of the second coupling member 33 as illustrated in FIG. 13) and a second side surface (a lower side surface of the second coupling member 33 as illustrated in FIG. 13) in the length direction of the first heat exchange tube 21. The first side surface of the first plate 37 is coupled to the first side surface of the first coupling member 32, and the second side surface of the first plate 37 is coupled to the first side surface of the second coupling member 33. The first plate 37 has a third side surface (a lower side surface of the first plate 37 as illustrated in FIG. 13) and a fourth side surface (an upper side surface of the first plate 37 as illustrated in FIG. 13) in the length direction of the first heat exchange tube 21. The third side surface of the first plate 37 is coupled to the third ends of the plurality of body members 31, and the fourth side surface of the first plate 37 is arranged adjacent to the inner wall surface of the first collecting tube 11.

And/or, the first assembly 3 further includes a second plate 38, and the second plate 38 has a first side surface (a front side surface of the second plate 38 as illustrated in FIG. 13) and a second side surface (a rear side surface of the second plate 38 as illustrated in FIG. 13) in the width direction of the first heat exchange tube 21. The first side surface of the second plate 38 is coupled to the second side surface of the first coupling member 32, and the second side surface of the second plate 38 is coupled to the second side surface of the second coupling member 33. The second plate 38 has a third side surface (a lower side surface of the second plate 38 as illustrated in FIG. 13) and a fourth side surface (an upper side surface of the second plate 38 as illustrated in FIG. 13) in the length direction of the first heat exchange tube 21. The fourth side surface of the second plate 38 is coupled to the fourth ends of the plurality of body members 31, and the third side surface of the second plate 38 is arranged adjacent to the inner wall surface of the first collecting tube 11.

As illustrated in FIGS. 12 and 13, the first assembly 31 further includes the first plate 37 and the second plate 38, and the first plate 37 and the second plate 38 are spaced apart in the up-down direction. The first plate 37 includes the upper side surface, the lower side surface, the front side surface and the rear side surface, and the second plate 38 includes the upper side surface, the lower side surface, the front side surface and the rear side surface. The first coupling member 32 includes the upper side surface and the lower side surface, and the second coupling member 33 includes the upper side surface and the lower side surface.

The front side surface of the first plate 37 is coupled to the upper side surface of the first coupling member 32, the rear side surface of the first plate 37 is coupled to the upper side surface of the second coupling member 33, the front side surface of the second plate 38 is coupled to the lower side surface of the first coupling member 32, and the rear side surface of the second plate 38 is coupled to the lower side surface of the second coupling member 33. The upper side surface of the first plate 37 is coupled to the inner wall surface of the first peripheral wall 111, and the lower side surface of the second plate 38 is coupled to the inner wall surface of the first peripheral wall 111. The plurality of body members 31 are spaced apart in an area surrounded by the first plate 37, the second plate 38, the first coupling member 32 and the second coupling member 33 along the left-right direction. The upper ends of the plurality of body members 31 are coupled to the lower side surface of the first plate 37, and the lower ends of the plurality of body members 31 are coupled to the upper side surface of the second plate 38.

It can be understood that the present disclosure is not limited to this. In some optional embodiments, in the heat exchanger 100 according to embodiments of the present disclosure the first assembly 3 may only include the first plate 37, or the first assembly 3 may only include the second plate 38. The first plate 37 and the second plate 38 are conducive to improving the strength of the first collecting tube 11, or can reduce the wall thickness of the first collecting tube 11 under the condition of ensuring a certain strength requirement, thus reducing the processing difficulty. Moreover, the first plate 37 and the second plate 38 can reduce the internal volume in the first collecting tube 11 for containing the refrigerant, thus improving the performance of the heat exchanger while reducing the refrigerant charge.

In some embodiments, the second collecting tube 12 includes a second peripheral wall 121 and a second main channel 122 surrounded by the second peripheral wall 121. The heat exchanger 100 further includes a second assembly 4, a third inlet-outlet tube 15 and a fourth inlet-outlet tube 16.

The second assembly 4 is located in the second main channel 122. The second main channel 122 includes a third flow channel 123 and the fourth flow channel 124. At least part of the second assembly 4 abuts with an inner wall surface of the second collecting tube 12.

The third flow channel 123 includes a third channel 1231 and a plurality of third lumens 1232. The third channel 1231 extends in a length direction of the second collecting tube 12 (the left-right direction as illustrated in FIG. 1), and the third channel 1231 is in communication with the plurality of third lumens 1232. The fourth flow channel 124 includes a fourth channel 1241 and a plurality of fourth lumens 1242. The fourth channel 1241 extends in the length direction of the second collecting tube 12, and the fourth channel 1241 is in communication with the plurality of fourth lumens 1242.

The third lumen 1232 and the fourth lumen 1242 are alternately arranged along the length direction of the second collecting tube 12. The second assembly 4 separates the third lumen 1232 from the fourth lumen 1242, and the third lumen 1232 and the fourth lumen 1242 are not in communication with each other. The third lumen 1232 is in communication with the first heat exchange tube 21, and the fourth lumen 1242 is in communication with the second heat exchange tube 22. The first channel 1131, the first lumen 1132, the first heat exchange tube 21 and the third lumen 1232 are in communication with each other, and the second channel 1141, the second lumen 1142, the second heat exchange tube 22 and the fourth lumen 1242 are in communication with each other.

The third inlet-outlet tube 15 is in communication with the third channel 1231, and the fourth inlet-outlet tube 16 is in communication with the fourth channel 1241.

As illustrated in FIGS. 1 to 11, the heat exchanger 100 further includes the second assembly 4, the third inlet-outlet tube 15, and the fourth inlet-outlet tube 16.

The first collecting tube 11 and the second collecting tube 12 are arranged in parallel along the up-down direction and extend in the left-right direction. The second collecting tube 12 includes the second peripheral wall 121 and the second main channel 122 surrounded by the second peripheral wall 121. The second peripheral wall 121 includes a left wall and a right wall. The second assembly 4 is located in the second main channel 122. The second assembly 4 includes an upper end surface, a lower end surface, a front side surface and a rear side surface. The upper end surface of the second assembly 4 is coupled to the inner wall surface of the second peripheral wall 121, and the lower end surface of the second assembly 4 is coupled to the inner wall surface of the second peripheral wall 121. A gap is defined between the front side surface of the second assembly 4 and the inner wall surface of the second peripheral wall 121, and a gap is defined between the rear side surface of the second assembly 4 and the inner wall surface of the second peripheral wall 121. A left end of the second assembly 4 is coupled to the left wall of the second peripheral wall, and a right end of the second assembly 4 is coupled to the right wall of the second peripheral wall 121. Thus, the second assembly 4 separates the second main channel 122 into the third flow channel 123 and the fourth flow channel 124.

Further, the second assembly 4 extends in the left-right direction in the second main channel 121, and a longitudinal section of the second assembly 4 is approximately in an S-shape which is bent continuously. Therefore, the second assembly 4 separates the third flow channel 123 into one third channel 1231 and the plurality of third lumens 1232, and the third channel 1231 is in communication with the plurality of third lumens 1232. Similarly, the second assembly 4 separates the fourth flow channel 124 into one fourth channel 1241 and the plurality of fourth lumens 1242, and the fourth channel 1241 is in communication with the plurality of fourth lumens 1242.

The third lumen 1232 and the fourth lumen 1242 are alternately arranged along the left-right direction, and the third lumen 1232 and the fourth lumen 1242 are not in communication with each other. The third lumen 1232 is in communication with the first heat exchange tube 21, and the fourth lumen 1242 is in communication with the second heat exchange tube 22. Thus, an upper end of the first heat exchange tube 21 is in communication with the first lumen 1132, a lower end of the first heat exchange tube 21 is in communication with the third lumen 1232, an upper end of the second heat exchange tube 22 is in communication with the second lumen 1142, and a lower end of the second heat exchange tube 22 is in communication with the fourth lumen 1242.

The right wall of the second peripheral wall 121 includes a third coupling port 117 and a fourth coupling port 118 spaced apart from each other in the front-rear direction, and each of the third coupling port 117 and the fourth coupling port 118 penetrates through the right wall of the second peripheral wall 121 in the left-right direction. The right end of the second assembly 4 is located between the third coupling port 117 and the fourth coupling port 118 to separate the third coupling port 117 from the fourth coupling port 118. The third inlet-outlet tube 15 passes through the third coupling port 117, and the third inlet-outlet tube 15 is in communication with the third channel 1231. The fourth inlet-outlet tube 16 passes through the fourth coupling port 118, and the fourth inlet-outlet tube 16 is in communication with the fourth channel 1241. Therefore, two refrigerant channels separated from each other are formed.

It can be understood that the present disclosure is not limited to this. In some optional embodiments, the first assembly 3 and the second assembly 4 according to embodiments of the present disclosure have the same structure, and the first assembly 3 and the second assembly 4 are arranged in the first collecting tube 11 and the second collecting tube 12, respectively.

Figure 15:
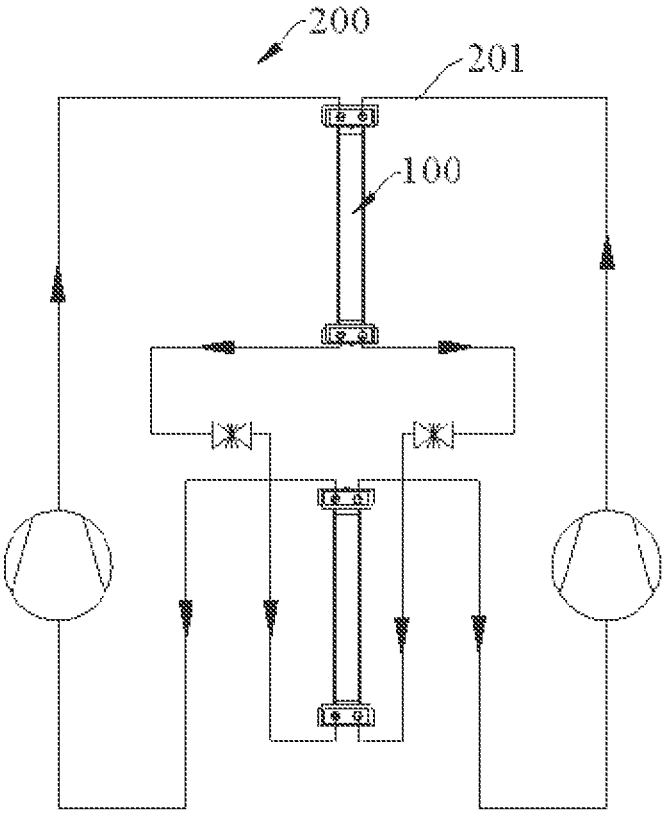
FIG. 15 is a schematic view of an air conditioning unit having multiple refrigeration systems according to an embodiment of the present disclosure.

As illustrated in FIG. 15, an air conditioning unit 200 having multiple refrigeration systems according to embodiments of the present disclosure includes a plurality of refrigeration systems 201. At least two refrigeration systems 201 of the plurality of refrigeration systems 201 share at least one heat exchanger 100. The heat exchanger 100 is an evaporator and/or a condenser of the at least two refrigeration systems 201. The heat exchanger 100 is a heat exchanger 100 in any embodiment of the present disclosure.

The air conditioning unit according to embodiments of the present disclosure includes the plurality of refrigeration systems. At least two refrigeration systems of the plurality of refrigeration systems share at least one heat exchanger in any one of the above embodiments. In the heat exchanger, the first collecting tube and the second collecting tube are provided and arranged in parallel, and the plurality of first heat exchange tubes and the plurality of second heat exchange tubes are arranged between the first collecting tube and the second collecting tube, and alternately arranged along the length direction of the first collecting tube. The first assembly is arranged in the first collecting tube to separate the first main channel in the first collecting tube into the first flow channel and the second flow channel, and the first flow channel and the second flow channel are not in communication with each other. The first flow channel includes the first channel and the plurality of first lumens, and the plurality of first lumens are coupled to the plurality of first heat exchange tubes, respectively. The second flow channel includes the second channel and the plurality of second lumens, and the plurality of second lumens are coupled to the plurality of second heat exchange tubes, respectively. Therefore, when the heat exchanger is applied in the air conditioning unit having multiple refrigeration systems, the refrigerant may only circulate in the first flow channel and the first heat exchange tube, or the refrigerant may only circulate in the second flow channel and the second heat exchange tube, or the refrigerant may not only circulate in the first flow channel and the first heat exchange tube, but also circulate in the second flow channel and the second heat exchange tube. The heat exchanger can improve the utilization rate of the heat exchange area, which is conducive to improving the performance of the system.

In the description of the present disclosure, terms such as "an embodiment," "some embodiments," "an example," "a specific example," or "some examples," means that a particular feature, structure, material, or characteristic described in coupling with the embodiment or example is included in at least one embodiment or example of the present disclosure. Thus, the appearances of these terms in various places throughout this specification are not necessarily referring to the same embodiment or example of the present disclosure. Furthermore, the particular features, structures, materials, or characteristics may be combined in any suitable manner in one or more embodiments or examples. In addition, without contradiction, those skilled in the art may combine and unite different embodiments or examples or features of the different embodiments or examples described in this specification.

Although embodiments of the present disclosure have been shown and described above, it can be understood that the above embodiments are illustrative and shall not be understood as limitation to the present disclosure, and changes, modifications, alternatives and variations can be made in the above embodiments within the scope of the present disclosure by those skilled in the art.

What is claimed is:

1. A heat exchanger, comprising:

a first collecting tube and a second collecting tube, the first collecting tube comprising a first peripheral wall and a first main channel, and a wall surrounding the first main channel comprising the first peripheral wall;

a plurality of heat exchange tubes spaced apart along a length direction of the first collecting tube, the heat exchange tube being coupled to the first collecting tube, the heat exchange tube being coupled to the second collecting tube, the plurality of heat exchange tubes comprising a plurality of first heat exchange tubes and a plurality of second heat exchange tubes, the first heat exchange tube and the second heat exchange tube being alternately arranged along the length direction of the first collecting tube, and at least two second heat exchange tubes being arranged adjacent to the first heat exchange tube in the length direction of the first collecting tube;

a first assembly located in the first main channel, the first main channel comprising a first flow channel and a second flow channel, at least part of the first assembly being fixedly coupled to an inner wall surface of the first collecting tube, the first flow channel comprising a first channel and a plurality of first lumens, the first channel extending in the length direction of the first collecting tube and in communication with the plurality of first lumens, the second flow channel comprising a second channel and a plurality of second lumens, the second channel extending in the length direction of the first collecting tube and in communication with the plurality of second lumens, the first lumen and the second lumen being alternately arranged along the length direction of the first collecting tube, the first assembly separating the first lumen from the second lumen, the first lumen and the second lumen being not in communication with each other, the first lumen being in communication with the first heat exchange tube, and the second lumen being in communication with the second heat exchange tube;

a first inlet-outlet tube in communication with the first channel; and a second inlet-outlet tube in communication with the second channel.

2. The heat exchanger according to claim 1, wherein a peripheral profile of a cross section of the heat exchange tube is generally flat, the first assembly comprises a plurality of body members, the plurality of body members are spaced apart along the length direction of the first collecting tube, each of the plurality of body members:

has a first end and a second end in a width direction of the first heat exchange tube, has a third end and a fourth end in a length direction of the first heat exchange tube, wherein the third end of the body member and the fourth end of the body member abut with the inner wall surface of the first collecting tube, a minimum distance between the first end of the body member and the second end of the body member is greater than a width of the first heat exchange tube, and the minimum distance between the first end of the body member and the second end of the body member is greater than a width of the second heat exchange tube; and the first assembly further comprises a first coupling member, the first coupling member extends in the length direction of the first collecting tube, a first end of the first coupling member in the length direction of the first collecting tube is coupled to the first end of one body member, a second end of the first coupling member in the length direction of the first collecting tube is coupled to the first end of another body member, a first gap is defined between the first coupling member and the inner wall surface of the first collecting tube, and the first channel comprises the first gap.

3. The heat exchanger according to claim 2, wherein the first assembly further comprises a second coupling member, the second coupling member extends in the length direction of the first collecting tube, a first end of the second coupling member in the length direction of the first collecting tube is coupled to the second end of one body member, a second end of the second coupling member in the length direction of the first collecting tube is coupled to the second end of another body member, a second gap is defined between the second coupling member and the inner wall surface of the first collecting tube, and the second channel comprises the second gap.

4. The heat exchanger according to claim 3, wherein three adjacent body members of the plurality of body members in the length direction of the first collecting tube are defined as a first body member, a second body member and a third body member, the first body member and the second body member are adjacent in the length direction of the first collecting tube, the second body member and the third body member are adjacent in the length direction of the first collecting tube, a direction from the first body member to the second body member is the same as a direction from the second body member to the third body member, a plurality of first coupling members are provided, the plurality of first coupling members are arranged along the length direction of the first collecting tube, a first end of the first coupling member in the length direction of the first collecting tube is coupled to a first end of the first body member, a second end of the first coupling member is coupled to a first end of the second body member, and a gap is defined between a second end of the first body member and a second end of the second body member; and a plurality of second coupling members are provided, the plurality of second coupling members are arranged along the length direction of the first collecting tube, a first end of the second coupling member in the length direction of the first collecting tube is coupled to the second end of the second body member, a second end of the second coupling member in the length direction of the first collecting tube is coupled to a second end of the third body member, a gap is defined between the first end of the second body member and a first end of the third body member.

5. The heat exchanger according to claim 4, wherein a peripheral wall surrounding the first lumen comprises the second body member, the third body member, the second coupling member coupling the second end of the second body member and the second end of the third body member, and an inner wall of the first collecting tube, the first lumen is in communication with the first channel; and a peripheral wall surrounding the second lumen comprises the first body member, the second body member, the first coupling member coupling the first end of the first body member and the first end of the second body member, and the inner wall of the first collecting tube, the second lumen is in communication with the second channel.

6. The heat exchanger according to claim 4, wherein the first assembly further comprises a third coupling member, the third coupling member extends in the length direction of the first collecting tube, a gap is defined between a first end of the third coupling member in the length direction of the first collecting tube and the second end of the first body member, a second end of the third coupling member in the length direction of the first collecting tube is coupled to the second end of the second body member, a peripheral wall surrounding the second lumen comprises the first body member, the second body member, the first coupling member coupling the first end of the first body member and the first end of the second body member, the third coupling member and an inner wall of the first collecting tube, and the second lumen is in communication with the second channel; and the first assembly further comprises a fourth coupling member, the fourth coupling member extends in the length direction of the first collecting tube, a gap is defined between a first end of the fourth coupling member in the length direction of the first collecting tube and the first end of the second body member, a second end of the fourth coupling member in the length direction of the first collecting tube is coupled to the first end of the third body member, a peripheral wall surrounding the first lumen comprises the second body member, the third body member, the second coupling member coupling the second end of the second body member and the second end of the third body member, the fourth coupling member and the inner wall of the first collecting tube, and the first lumen is in communication with the first channel.

7. The heat exchanger according to claim 4, wherein a size of the first coupling member in the length direction of the first collecting tube is greater than or equal to a size of the second coupling member in the length direction of the first collecting tube.

8. The heat exchanger according to claim 1, wherein a peripheral profile of a cross section of the heat exchange tube is generally flat, the first assembly comprises a plurality of body members, the plurality of body members are spaced apart along the length direction of the first collecting tube, each of the plurality of body members has a first end and a second end in a width direction of the first heat exchange tube, two of the body members of the plurality of body members are adjacent to each other in the length direction of the first collecting tube, first ends of the two body members are coupled to each other, second ends of the two body members are spaced apart, a gap is defined between a coupling portion of the first ends of the two body members and the inner wall surface of the first collecting tube, each of the plurality of body members has a third end and a fourth end in a length direction of the first heat exchange tube, and third ends and fourth ends of part of the body members abut with the inner wall surface of the first collecting tube.

9. The heat exchanger according to claim 8, wherein two body members of the plurality of body members are adjacent to each other in the length direction of the first collecting tube, second ends of the two body members are coupled to each other, first ends of the two body members are spaced apart, a gap is defined between a coupling portion of the second ends of the two body members and the inner wall surface of the first collecting tube, in the length direction of the first collecting tube, and the coupling portion of the first ends of two adjacent body members and the coupling portion of the second ends of two adjacent body members are alternately arranged.

10. The heat exchanger according to claim 3, wherein three adjacent body members of the plurality of body members in the length direction of the first collecting tube are defined as a first body member, a second body member and a third body member, the first body member and the second body member are adjacent in the length direction of the first collecting tube, the second body member and the third body member are adjacent in the length direction of the first collecting tube, a direction from the first body member to the second body member is the same as a direction from the second body member to the third body member, a plurality of first coupling members are provided, a first end of one first coupling member in the length direction of the first collecting tube is coupled to a first end of the first body member, a second end of the one first coupling member in the length direction of the first collecting tube is coupled to a first end of the second body member, a plurality of second coupling members are provided, a first end of one second coupling member in the length direction of the first collecting tube is coupled to a second end of the first body member, a second end of the one second coupling member in the length direction of the first collecting tube is coupled to a second end of the second body member, the first coupling member comprises a first through hole, a peripheral wall surrounding the first lumen comprises the one first coupling member, the one second coupling member, the first body member and the second body member, the first through hole penetrates through the first coupling member in the width direction of the first heat exchange tube and communicates the first lumen with the first channel.

11. The heat exchanger according to claim 10, wherein a first end of the one first coupling member in the length direction of the first collecting tube is coupled to the first end of the second body member, a second end of the one first coupling member in the length direction of the first collecting tube is coupled to a first end of the third body member, a plurality of second coupling members are provided, a first end of one second coupling member in the length direction of the first collecting tube is coupled to the second end of the second body member, a second end of the one second coupling member in the length direction of the first collecting tube is coupled to a second end of the third body member, the second coupling member comprises a second through hole, a peripheral wall surrounding the second lumen comprises the one first coupling member, the one second coupling member, the second body member and the third body member, the second through hole penetrates through the second coupling member in the width direction of the first heat exchange tube and communicates the second lumen with the second channel.

12. The heat exchanger according to claim 3, wherein the first coupling member and the second coupling member are spaced apart in the width direction of the first heat exchange tube, the first ends of the plurality of body members are coupled to the first coupling member, the second ends of the plurality of body members are coupled to the second coupling member, two body members of the plurality of body members adjacent to each other in the length direction of the first collecting tube are defined as a first body member and a second body member, another two body members adjacent to each other in the length direction of the first collecting tube are defined as a third body member and a fourth body member, the first coupling member comprises a plurality of first through holes, the first through hole penetrates through the first coupling member in the width direction of the first heat exchange tube, the second coupling member comprises a plurality of second through holes, the second through hole penetrates through the second coupling member in the width direction of the first heat exchange tube, a peripheral wall forming the first lumen comprises part of the first coupling member, part of the second coupling member, the first body member, the second body member and part of the first peripheral wall, the first through hole communicates the first lumen with the first channel, a peripheral wall forming the second lumen comprises part of the first coupling member, part of the second coupling member, the third body member, the fourth body member and part of the first peripheral wall, the second through hole communicates the second lumen with the second channel, the first lumen is not in communication with the second channel, and the second lumen is not in communication with the first channel.

13. The heat exchanger according to claim 1, wherein the first collecting tube is a circular tube, each of an end surface of the third end and an end surface of the fourth end of the body member is an arc-shaped surface projecting towards the inner wall surface of the first collecting tube, and each of the end surface of the third end and the end surface of the fourth end of the body member is coupled to the inner wall surface of the first collecting tube.

14. The heat exchanger according to claim 1, wherein the first collecting tube is a circular tube, a rectangular tube or a square tube, the first assembly further comprises a first plate, the first plate has a first side surface and a second side surface in the width direction of the first heat exchange tube, the first coupling member has a first side surface and a second side surface in the length direction of the first heat exchange tube, the second coupling member has a first side surface and a second side surface in the length direction of the first heat exchange tube, the first side surface of the first plate is coupled to the first side surface of the first coupling member, and the second side surface of the first plate is coupled to the first side surface of the second coupling member;

the first plate has a third side surface and a fourth side surface in the length direction of the first heat exchange tube, the third side surface of the first plate is coupled to the third ends of the plurality of body members, and the fourth side surface of the first plate is arranged adjacent to the inner wall surface of the first collecting tube;

and/or, the first assembly further comprises a second plate, the second plate has a first side surface and a second side surface in the width direction of the first heat exchange tube, the first side surface of the second plate is coupled to the second side surface of the first coupling member, and the second side surface of the second plate is coupled to the second side surface of the second coupling member;

the second plate has a third side surface and a fourth side surface in the length direction of the first heat exchange tube, the fourth side surface of the second plate is coupled to the fourth ends of the plurality of body members, and the third side surface of the second plate is arranged adjacent to the inner wall surface of the first collecting tube.

15. The heat exchanger according to claim 1, wherein the second collecting tube comprises a second peripheral wall and a second main channel surrounded by the second peripheral wall, the heat exchanger further comprises a second assembly, a third inlet-outlet tube and a fourth inlet-outlet tube, the second assembly is located in the second main channel, the second main channel comprises a third flow channel and a fourth flow channel, at least part of the second assembly abuts with an inner wall surface of the second collecting tube, the third flow channel comprises a third channel and a plurality of third lumens, the third channel extends in a length direction of the second collecting tube and is in communication with the plurality of third lumens, the fourth flow channel comprises a fourth channel and a plurality of fourth lumens, the fourth channel extends in the length direction of the second collecting tube and is in communication with the plurality of fourth lumens, the third lumen and the fourth lumen are alternately arranged along the length direction of the second collecting tube, the second assembly separates the third lumen from the fourth lumen, the third lumen and the fourth lumen are not in communication with each other, the third lumen is in communication with the first heat exchange tube, the fourth lumen is in communication with the second heat exchange tube, the first channel, the first lumen, the first heat exchange tube and the third lumen are in communication with each other, and the second channel, the second lumen, the second heat exchange tube and the fourth lumen are in communication with each other; and the third inlet-outlet tube is in communication with the third channel, and the fourth inlet-outlet tube is in communication with the fourth channel.

16. An air conditioning unit having multiple refrigeration systems, comprising:

a plurality of refrigeration systems, at least two refrigeration systems of the plurality of refrigeration systems sharing at least one heat exchanger, the heat exchanger being an evaporator and/or a condenser of the at least two refrigeration systems, wherein the heat exchanger comprises:

a first collecting tube and a second collecting tube, the first collecting tube comprising a first peripheral wall and a first main channel, and a wall surrounding the first main channel comprising the first peripheral wall;

a plurality of heat exchange tubes spaced apart along a length direction of the first collecting tube, the heat exchange tube being coupled to the first collecting tube, the heat exchange tube being coupled to the second collecting tube, the plurality of heat exchange tubes comprising a plurality of first heat exchange tubes and a plurality of second heat exchange tubes, the first heat exchange tube and the second heat exchange tube being alternately arranged along the length direction of the first collecting tube, and at least two second heat exchange tubes being arranged adjacent to the first heat exchange tube in the length direction of the first collecting tube;

a first assembly located in the first main channel, the first main channel comprising a first flow channel and a second flow channel, at least part of the first assembly being fixedly coupled to an inner wall surface of the first collecting tube, the first flow channel comprising a first channel and a plurality of first lumens, the first channel extending in the length direction of the first collecting tube and in communication with the plurality of first lumens, the second flow channel comprising a second channel and a plurality of second lumens, the second channel extending in the length direction of the first collecting tube and in communication with the plurality of second lumens, the first lumen and the second lumen being alternately arranged along the length direction of the first collecting tube, the first assembly separating the first lumen from the second lumen, the first lumen and the second lumen being not in communication with each other, the first lumen being in communication with the first heat exchange tube, and the second lumen being in communication with the second heat exchange tube;

a first inlet-outlet tube in communication with the first channel; and a second inlet-outlet tube in communication with the second channel.

17. The air conditioning according to claim 16, wherein a peripheral profile of a cross section of the heat exchange tube is generally flat, the first assembly comprises a plurality of body members, the plurality of body members are spaced apart along the length direction of the first collecting tube, each of the plurality of body members has a first end and a second end in a width direction of the first heat exchange tube, each of the plurality of body members has a third end and a fourth end in a length direction of the first heat exchange tube, the third end of the body member and the fourth end of the body member abut with the inner wall surface of the first collecting tube, a minimum distance between the first end of the body member and the second end of the body member is greater than a width of the first heat exchange tube, and the minimum distance between the first end of the body member and the second end of the body member is greater than a width of the second heat exchange tube; and the first assembly further comprises a first coupling member, the first coupling member extends in the length direction of the first collecting tube, a first end of the first coupling member in the length direction of the first collecting tube is coupled to the first end of one body member, a second end of the first coupling member in the length direction of the first collecting tube is coupled to the first end of another body member, a first gap is defined between the first coupling member and the inner wall surface of the first collecting tube, and the first channel comprises the first gap.

18. The air conditioning according to claim 17, wherein the first assembly further comprises a second coupling member, the second coupling member extends in the length direction of the first collecting tube, a first end of the second coupling member in the length direction of the first collecting tube is coupled to the second end of one body member, a second end of the second coupling member in the length direction of the first collecting tube is coupled to the second end of another body member, a second gap is defined between the second coupling member and the inner wall surface of the first collecting tube, and the second channel comprises the second gap.

19. The air conditioning according to claim 18, wherein three adjacent body members of the plurality of body members in the length direction of the first collecting tube are defined as a first body member, a second body member and a third body member, the first body member and the second body member are adjacent in the length direction of the first collecting tube, the second body member and the third body member are adjacent in the length direction of the first collecting tube, a direction from the first body member to the second body member is the same as a direction from the second body member to the third body member, a plurality of first coupling members are provided, the plurality of first coupling members are arranged along the length direction of the first collecting tube, a first end of the first coupling member in the length direction of the first collecting tube is coupled to a first end of the first body member, a second end of the first coupling member is coupled to a first end of the second body member, and a gap is defined between a second end of the first body member and a second end of the second body member; and a plurality of second coupling members are provided, the plurality of second coupling members are arranged along the length direction of the first collecting tube, a first end of the second coupling member in the length direction of the first collecting tube is coupled to the second end of the second body member, a second end of the second coupling member in the length direction of the first collecting tube is coupled to a second end of the third body member, a gap is defined between the first end of the second body member and a first end of the third body member.

20. The air conditioning according to claim 19, wherein a peripheral wall surrounding the first lumen comprises the second body member, the third body member, the second coupling member coupling the second end of the second body member and the second end of the third body member, and an inner wall of the first collecting tube, the first lumen is in communication with the first channel; and a peripheral wall surrounding the second lumen comprises the first body member, the second body member, the first coupling member coupling the first end of the first body member and the first end of the second body member, and the inner wall of the first collecting tube, the second lumen is in communication with the second channel.

* * * * *